US007367816B2

(12) United States Patent
Liu

(10) Patent No.: US 7,367,816 B2
(45) Date of Patent: May 6, 2008

(54) BOARD-TO-BOARD CONNECTORS

(75) Inventor: Jun-Xian Liu, Northern (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/803,964

(22) Filed: May 16, 2007

(65) Prior Publication Data

US 2007/0218716 A1 Sep. 20, 2007

Related U.S. Application Data

(63) Continuation of application No. 11/347,157, filed on Feb. 3, 2006, now abandoned.

(30) Foreign Application Priority Data

Feb. 4, 2005 (CN) ..... 2005 2 000233 U

(51) Int. Cl.
*H01R 12/00* (2006.01)

(52) U.S. Cl. ..... 439/74

(58) Field of Classification Search ..... 439/74, 439/284, 285, 660, 296, 246, 248, 81
See application file for complete search history.

(56) References Cited

U.S. PATENT DOCUMENTS 5,695,353 A 12/1997 Sakata et al.
5,975,916 A 11/1999 Okura
6,244,883 B1 6/2001 Ito et al.
6,623,308 B2 * 9/2003 Ono ..... 439/680
6,764,314 B1 7/2004 Lee
7,059,908 B2 6/2006 Yamaguchi
2006/0089037 A1 4/2006 Shindo et al.

* cited by examiner

*Primary Examiner*—Chandrika Prasad
(74) *Attorney, Agent, or Firm*—Charles S. Cohen

(57) ABSTRACT

An electrical connector assembly includes a socket connector soldered on one circuit board and a plug connector soldered on another circuit board. The socket connector includes an insulating socket base and a plurality of first terminals received in the first terminal-receiving slots of the insulating socket base. Each first terminal successively extends to form a first terminal lead, a first inverted U-shaped portion, a base U-shaped portion and an auxiliary-clamping portion. One leg of the base U-shaped portion includes a first elastic-contact portion. The plug connector includes an insulating plug base and a plurality of second terminals received in the second terminal-receiving slots of the insulating plug base. Each second terminal successively extends to form a second terminal lead and a second inverted U-shaped portion having a second elastic-contact portion. The second inverted U-shaped portion of the second terminal is inserted into the base U-shaped portion of the first terminal, and the first elastic-contact portion contacts the second elastic-contact portion when mating. The invention can provide stable mating and electrical connection and is in compliance with recent downsizing trends.

15 Claims, 6 Drawing Sheets

BOARD-TO-BOARD CONNECTORS

FIELD OF THE PRESENT INVENTION

The present invention relates to an electrical connector assembly, more specifically to a low profile board-to-board connector for transferring high-speed communication signals.

DESCRIPTION OF RELATED ART

U.S. Pat. No. 5,975,916 discloses an electrical connector assembly including a socket and a plug whose surfaces are respectively mounted on two corresponding circuit board to interconnect the two circuit boards. This reference as shown in FIG. 1 herein, discloses a socket 6 of the electrical connector assembly which includes a rectangular dielectric socket base 60 and a plurality of first terminals 61 parallel mounted in the socket base 60. Two banks 600 project from two sides along the length of the socket base 60 to define a recess 601 between the banks. Each bank 600 comprises a plurality of vertical terminal-receiving slots 602 with evenly spaced openings for securing the first terminals 61. A rib 603 integrally molded with the socket base 60 projects from the bottom of the base 60 into each terminal-receiving slot 602. Each first terminal 61 has an S-shaped portion and a terminal lead 610. The S-shaped portion is composed of an inverted U-shaped portion 611 and an upright U-shaped portion 612. Each has two legs, in which one leg is used in common as a connection of the upright U-shaped portion 612 and the inverted U-shaped portion 611. One leg of the upright U-shaped portion 612 is connected to the inverted U-shaped portion 611, and the other leg defines a first elastic-contact portion 613. The free end of the first elastic-contact portion 613 bends to provide a first contact end 614. The terminal lead 610 extends horizontally outwards from the lower end of the leg of the inverted U-shaped portion 611. Each first terminal 61 is secured in the corresponding terminal-receiving slot 602 with a straight tab 615 and a locking tab 616 projecting from the opposite edges of each leg of the inverted U-shaped portion 611. The first contact end 614 projects into the recess 601 and the first terminal lead 610 extends horizontally from the bottom of the socket base 60 to be soldered on the printed board 8 (as shown in FIG. 3). The rib 603 in each terminal-receiving slot 602 fits the inside of the inverted U-shaped portion 611 and supports the upright U-shaped portion 612, thereby allowing the first elastic-contact portion 613 to be extendable or retractable in a direction that narrows the width of the upright U-shaped portion 612.

As shown in FIG. 2, the plug 7 of the electrical assembly in the prior art includes an insulating plug base 70 and a plurality of second terminals 71. The plug base 70 includes an elongated central portion 700 projecting from the bottom for engagement into the recess 601 of the socket base 6. Vertical terminal-receiving slots 701 are formed at two laterally opposed sides of the central portion 700 to receive the corresponding second terminals 71. Each second terminal 71 has a U-shaped portion 710 with a pair of legs, with one leg serving as a second elastic-contact portion 711 and the other an anchor leg 712 for engagement with the central portion 700. A second terminal lead 713 is bent from the lower end of the second anchor leg 712 and extends horizontally over the lower end of the second elastic leg. Formed at the lower end of the second-contact portion 711 is a dent 714 which serves as a second contact end 715 for catching the first contact end 614 of the first terminal 61 to provide a latching engagement between them. Each second terminal 71 is press-fit in the individual terminal-receiving slot 701 with a straight tab 716 and a locking tab 717 provided on the opposite edges of the anchor leg 712, the second elastic contact 711 is exposed to the exterior of the central portion 700, and the second terminal lead 713 extends horizontally from the bottom of the plug base 70 for surface-mounting to the corresponding printed board (as shown in FIG. 3). The U-shaped portion 710 is held in position with the anchor leg 712 supported by the central portion 700, so that the second elastic-contact portion 711 is allowed to flex inwardly when engaging with the first elastic-contact portion 613.

As shown in FIG. 3, when inserting the central portion 700 of the socket 7 into the recess 601 of the socket 6, the first and second elastic-contact portions 613 and 711 both flex inwardly to generate elastic biases so as to induce sufficient contact pressure between them. However, the structure of the aforementioned electrical connector assembly, with the first contact end 614 protruding at an angle and the second contact end 715 having a dent 714, could generate some deformation at the contact points. Therefore, after the first elastic-contact portion 613 of the first terminal 61 is engaged with the second elastic-contact portion 711 of the second terminal 71, the contact positive pressure developed therebetween may not be sufficient, affecting the electrical connection between the first terminal 61 and the second terminal 71. In addition, the height of the entire connector assembly after engagement is tall, which compares unfavorably to recent downsizing trends. Therefore, it is necessary to improve the known electrical connector assembly to provide more stable and effective electrical connections.

SUMMARY OF THE INVENTION

An objective of the present invention is to provide an electrical connector assembly in which the plug connector can accurately mate with and closely contact the socket connector so as to accomplish a reliable electrical connection therebetween.

To achieve the above objective, an electrical connector assembly is provided for electrically connecting two circuit boards. The electrical connector assembly comprises a socket connector and a plug connector configured to match with the socket connector. The socket connector includes an insulating socket base and a plurality of first terminals received in first terminal-receiving slots of the insulating socket base. The plug connector includes an insulating plug base and a plurality of second terminals received in second terminal-receiving slots of the insulating plug base. Each first terminal successively extends a first terminal lead soldered on one of the two circuit boards, a first inverted U-shaped portion, an upright U-shaped portion and an elastic tail. Each second terminal successively extends a second terminal lead soldered on the other of the two circuit boards, and a second inverted U-shaped portion. The second inverted U-shaped portion of the second terminal inserts into the upright U-shaped portion of the first terminal to form an electrical connection therebetween when the plug connector mates with the socket connector.

The first inverted U-shaped portion of the first terminal is composed of two legs, one of which, extending from the first terminal lead, is provided with tabs on its two edges respectively to fix the first terminal in the corresponding position of the first terminal-receiving slot and the other of which connects with one leg of the upright U-shaped portion. A rib is provided inside each first terminal-receiving slot of the insulating socket base, which fits inside of the first inverted U-shaped portion. One leg of the upright U-shaped portion of the first terminal defines a first elastic-contact portion, the end of which bends first inward, then bends outward, and then extends downward with an elastic tail. The elastic tail of the first terminal is an auxiliary-clamping portion, and forms a transverse bar in its free end. The transverse bar abuts against the inside wall of the corresponding first terminal-receiving slot. The insulating socket base defines a mating space for mating with the plug connector, and the elongated transverse portion of the upright U-shaped portion of the first terminal is exposed to the mating space. The leg of the second inverted U-shaped portion of the second terminal, which is positioned away from the second terminal lead, is a second elastic-contact portion first bending inwardly, and the other leg is provided with tabs respectively protruding from the two edges thereof. A stop portion is provided inside each second terminal-receiving slot of the insulating plug base between the second lead of the second terminal and the inverted U-shaped portion, and abuts against the corresponding leg of the inverted U-shaped portion.

In addition, the insulating socket base of the socket connector is provided with at least one alignment hole, and the insulating plug base of the plug connector is correspondingly provided with at least one alignment block for engagement. The alignment block is received in the alignment hole when the socket connector mates with the plug connector.

The present invention also provides a socket connector for the above electrical connector assembly.

Compared with the prior art, the base U-shaped portion of the first terminal of the socket connector of the present invention has a larger thickness so as to receive the second inverted U-shaped portion of the plug connector for engagement and to provide more force in spite of the short terminal dimension. Moreover, an auxiliary clamping portion of the first terminal of the socket connector is pushed by the first terminal-receiving slot so as to increase the positive pressure between the first terminal and the second terminal and assure a stable electrical connection therebetween. In addition, the present invention provides an alignment hole and corresponding alignment block to improve the alignment accuracy of the structure when mating. Therefore, the present invention provides increased stability of terminal engagement and electrical connection, even with lower profile housings.

DETAILED DESCRIPTION OF THE INVENTION

To provide a clear understanding of the present invention, a detailed description of a preferred embodiment of the present invention with reference to the accompanying drawings is provided as follows.

Figure 1:
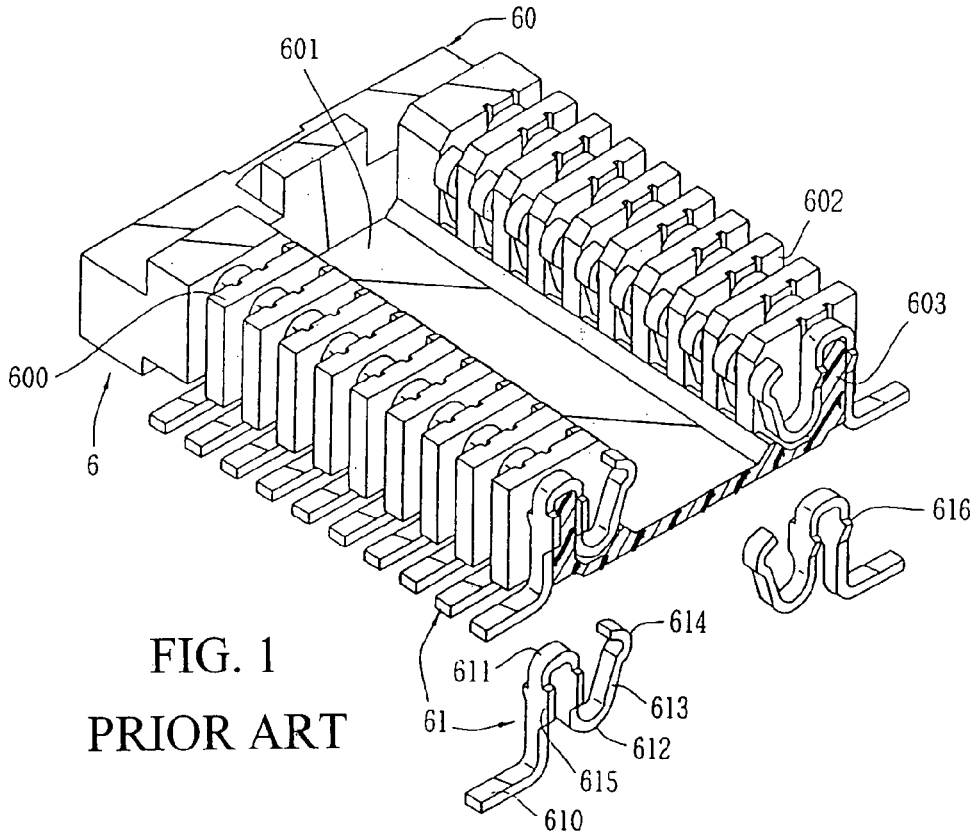
FIG. 1 PRIOR ART
FIG. 1 is a perspective view of a known socket connector of a electrical connector assembly in the prior art.
Figure 2:
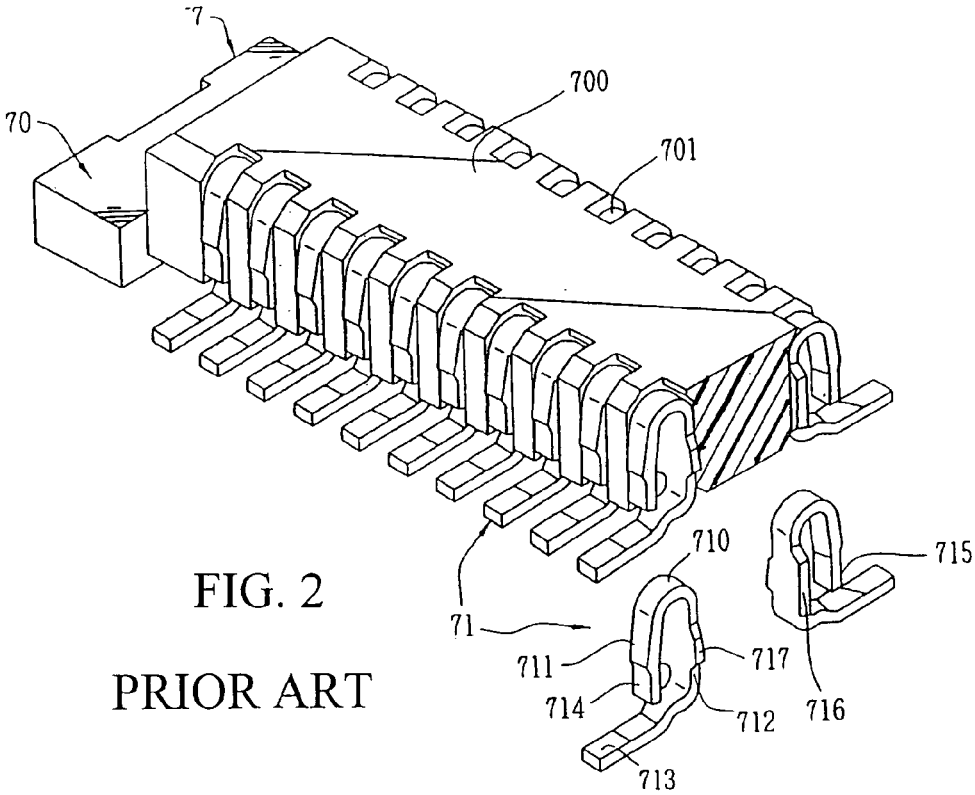
FIG. 2 PRIOR ART
FIG. 2 is a perspective view of a known plug connector configured to mate with the known socket connector in the prior art shown in FIG. 1.
Figure 3:
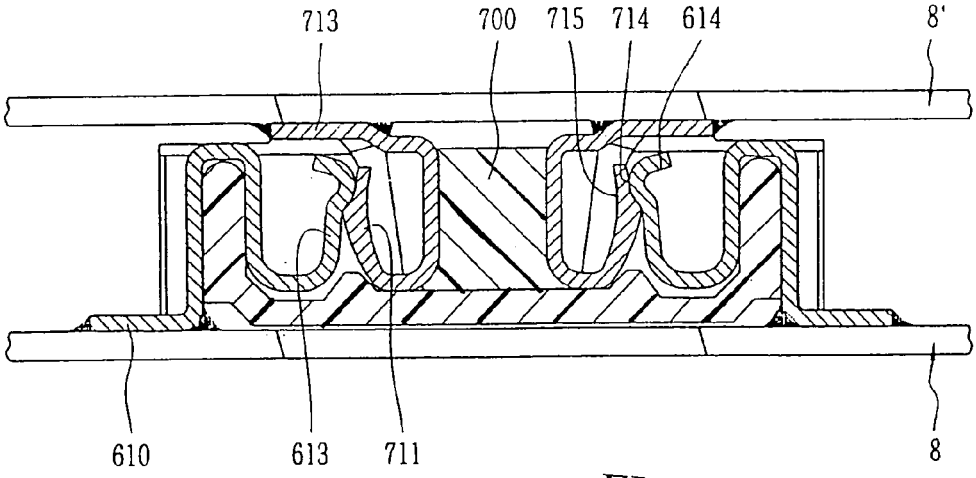
FIG. 3 PRIOR ART
FIG. 3 is a cross-sectional view of the known socket connector shown in FIG. 1 engaging with the known plug connector shown in FIG. 2.
Figure 4:
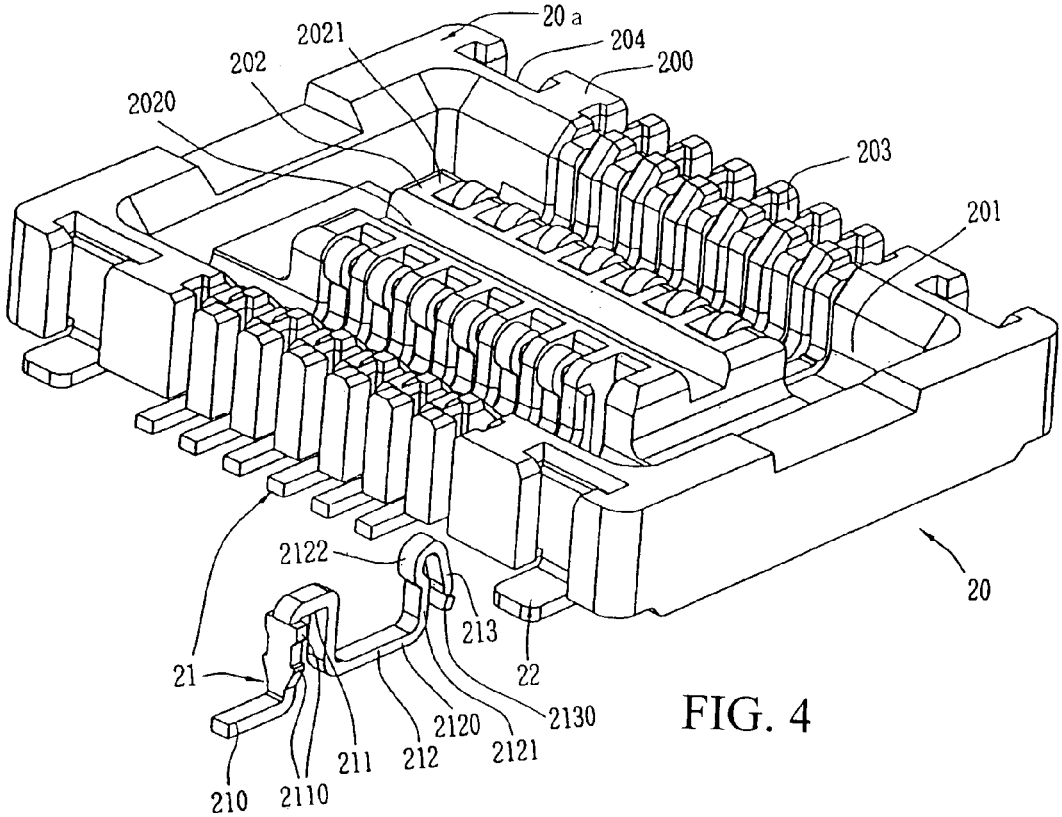
FIG. 4 is a perspective view of the socket connector of an electrical connector and an exploded first terminal of the present invention.
Figure 5:
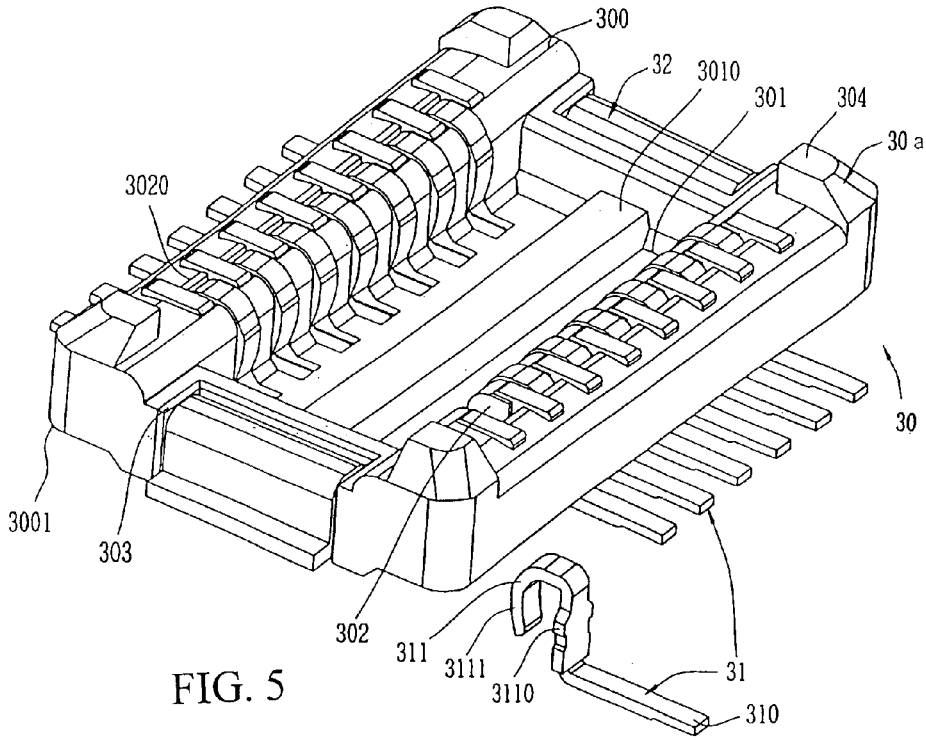
FIG. 5 is a perspective view of the plug connector mating with the socket connector shown in FIG. 4 and an exploded second terminal.
Figure 8:
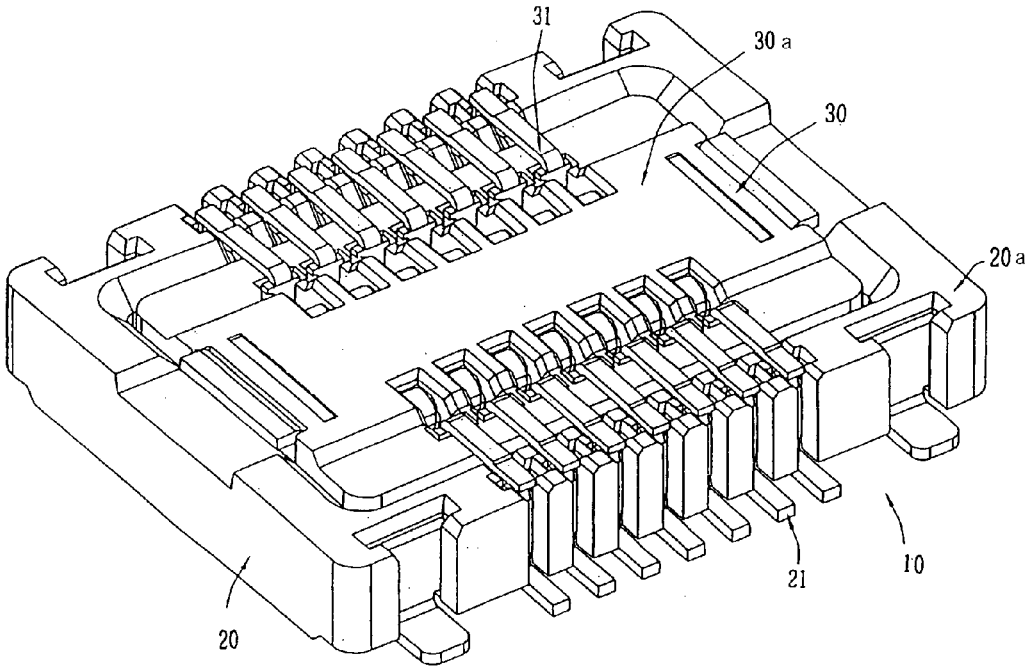
FIG. 8 is a perspective view of the electrical connector assembly with the socket connector shown in FIG. 4 engaging with the plug connector shown in FIG. 5.

As shown in FIGS. 4, 5 and 8, an electrical connector assembly 10 of the present invention is a board-to-board electrical connector including a socket connector 20 and a plug connector 30 respectively mounted on each circuit board (not shown) to accomplish the electrical connection between the two circuit boards by the engagement of the socket connector 20 and the plug connector 30.

Figure 6A:
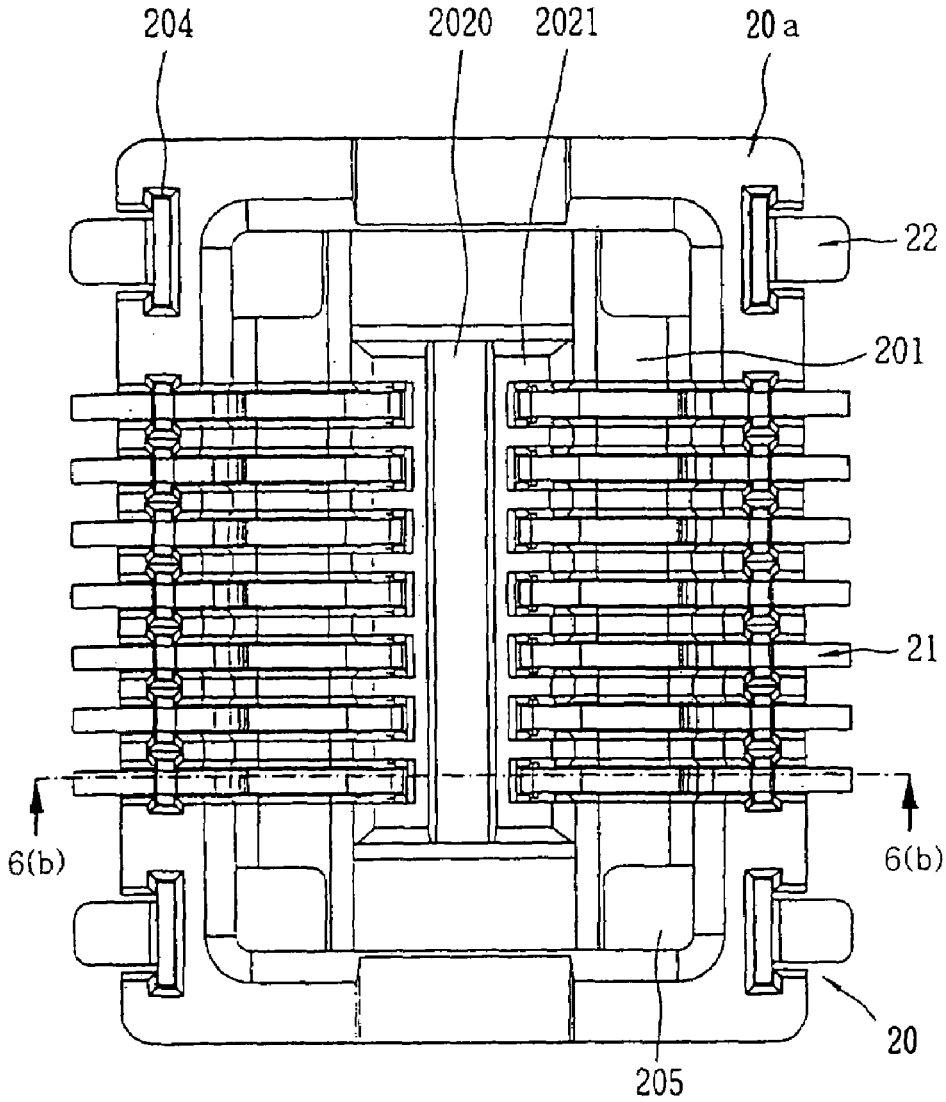
FIG. 6*a* is a top view of the socket connector shown in FIG. 4.
Figure 6B:
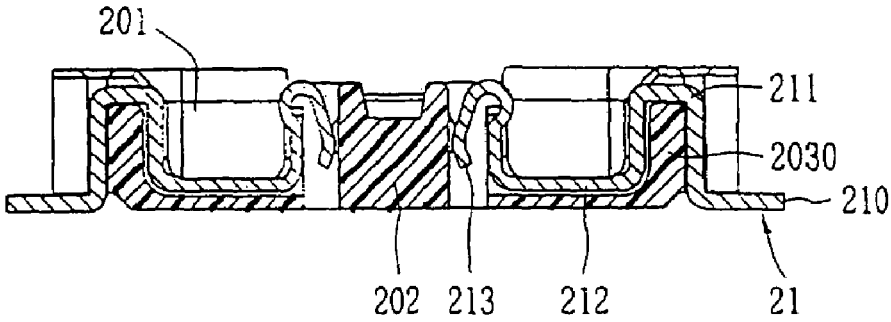
FIG. 6*b* is a cross-section view along direction 6(*b*)-6(*b*) in FIG. 6*a;*

As shown in FIGS. 4, 6*a* and 6*b*, the socket connector 20 of the electrical connector assembly 10 includes a rectangular insulating socket base 20*a*, a plurality of first terminals 21 mounted in parallel to the insulating base 20*a*, and two pairs of auxiliary-soldering tabs 22 mounted to the insulating socket base 20*a* to evenly fix the socket connector 20 to a circuit board.

Two first banks 200 protruding from opposite sides of the insulating socket base 20*a* form a mating space 201 therebetween. A platform 202 projecting from the central bottom of the mating space 201 extends along the length of the insulating socket base 20*a*. A recess 2020 is formed along the length of the upper surface of the platform 202, and two symmetrically elevated portions 2021 are formed at two sides of the recess 2020. A plurality of first terminal-receiving slots 203 evenly spaced along the length of the insulating socket base 20*a* extends in the length direction to each elevated portion 2021 between banks 200 on each side of the insulation socket base 20*a* for holding the corresponding first terminal 21. A rib 2030 projects from the bottom of the corresponding first bank 200 near the mating space 201 into each first terminal-receiving slot 203. Two pairs of clamping slots 204 are respectively formed in the two ends of the two first banks 200 in length direction to receive and fix the auxiliary-soldering tabs 22. In addition, alignment holes 205 are formed at and penetrate through the four corners of the bottom of the mating space 201 (as shown in FIG. 6*a*).

Each first terminal 21 includes a first terminal solder lead 210, a first inverted U-shaped portion 211, a base U-shaped portion 212 and an elastic tail 213 serving as an auxiliary-clamping portion in this embodiment. The first terminal solder lead 210 extends horizontally out of the first terminal-receiving slot 203 along the bottom of the insulating socket base 20*a* for soldering connection on the circuit board. The inverted U-shaped portion 211 is comprised of two legs, in which one leg, extending from the first terminal solder lead 210, defines tabs 2110 on its two sides to hold the first terminal 21 in the corresponding first terminal-receiving slot 203. The other leg is connected with one leg of the base U-shaped portion 212. The thickness of the base U-shaped portion 212 is larger than that of the first inverted U-shaped portion 211, and the transverse portion 2120 of the base U-shaped portion 212 is exposed to the mating space 201. In addition to the leg connected with the first inverted U-shaped portion 211, the other leg of the base U-shaped portion 212 defines a first elastic-contact portion 2121. The end 2122 of the first elastic-contact portion 2121 is first bent toward the inverted U-shaped portion 211 and follows by bending outward, and finally extends downward to form an auxiliary-clamping portion 213. The auxiliary-clamping portion 213 forms a transverse bar 2130 in its free end for abutting against the sidewall of platform 202 in the terminal-receiving slot 203 to hold each first terminal 21 in the first terminal-receiving slot 203. Once the plug connector 30 and the socket connector 20 are engaged the auxiliary-clamping portion 213 provides additional force to the elastic contact portion 2121 and helps to keep the plug and socket connector engaged. In addition, the rib 2030 of the first terminal-receiving slot 203 fits the first inverted U-shaped portion 211 to support the first inverted U-shaped portion 211, and the leg connects the upright U-shaped portion 211 and the first inverted U-shaped portion, allowing the base U-shaped portion 212 to be deformed in width direction.

Figure 7A:
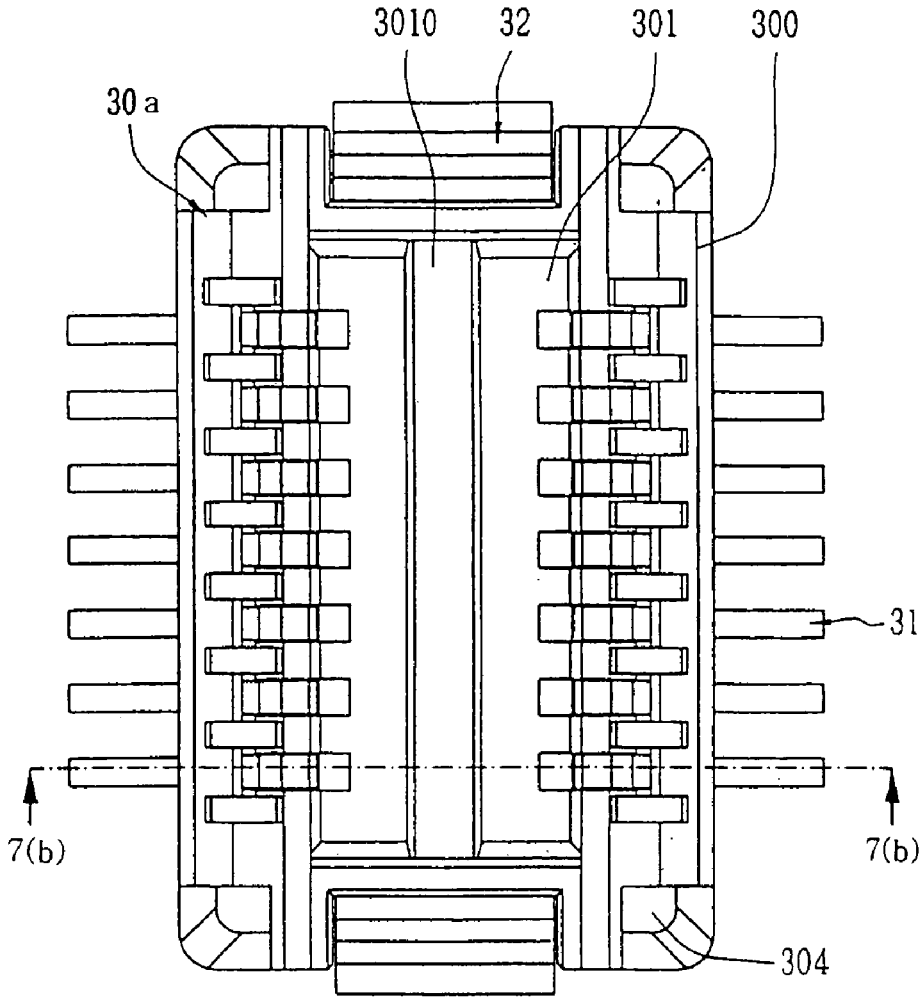
FIG. 7*a* is a top view of the plug connector shown in FIG. 5.
Figure 7B:
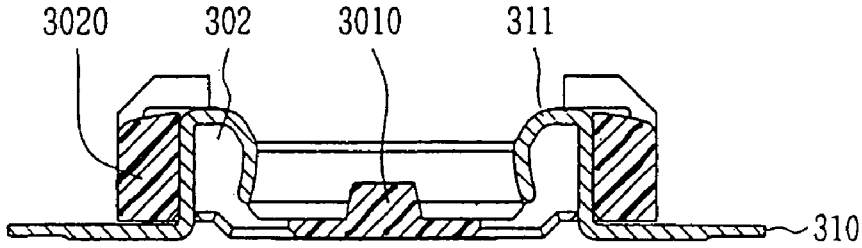
FIG. 7*b* is a cross-section view direction 7(*b*)-7(*b*) in FIG. 7*a;*

As shown in FIGS. 5, 7*a* and 7*b*, the plug connector 30 of the electrical connector assembly 1 includes an insulating plug base 30*a*, a plurality of second terminals 31, and two auxiliary-soldering portions 32. The insulating plug base 30*a* is substantially rectangular, and two second banks 300 project from opposite sides of the insulating plug base 30*a* and form a recess 301 therebetween. An elongated central portion 3010 projecting from the center of the bottom of the recess 301 fits the elongated recess 2020 of the socket connector 20. Two opposite second banks 300 extending along the length of the insulating plug base 30*a* are provided with a plurality of second terminal-receiving slots 302 to receive the corresponding second terminals 31. A stop portion 3020 in each second terminal-receiving slot 302 projects from the bottom of the second bank 300. Two recess slots 303 are provided in the center of the opposite banks 300 extending along the width of the insulating plug base 30*a* to allow the auxiliary-soldering portion 32 to be penetrated and fixed. Alignment blocks 304 respectively project from each abutment of second banks 300 on the upper surface of the insulating plug base 30*a*, and correspond to the alignment hole 205 of the socket connector 200, so as to align the socket connector 200 and the plug connector 300 to their mates. At the same time, the alignment blocks 304 can be received in the alignment holes 205 for accurate positioning. The auxiliary-soldering portion 32 is soldered on the other circuit board of the two circuit boards to evenly fix the plug connector 300 onto the circuit board.

Each second terminal 31 has a second terminal solder lead 310 and a second inverted U-shaped portion 311 with a pair of legs. The second terminal solder lead 310 extends out of the second terminal-receiving slot 302 for soldering the second terminal 31 onto the circuit board. The leg connecting the second inverted U-shape portion 311 and the second terminal lead 310 is provided with tabs respectively protruding from its two edges to secure the second terminal 31 in the corresponding second terminal-receiving slot 302. The other leg of the second inverted U-shaped portion 311 forms a second elastic-contact portion 3111 extending angled inward. The stop portion 3020 is formed in a portion where the leg of the inverted U-shaped portion 311 extends from the second terminal lead 3111 to support the leg for fixing, so as to assure the second elastic-contact portion 3111 is flexible in the direction of the thickness of the inverted U-shaped portion 311.

Figure 9A:
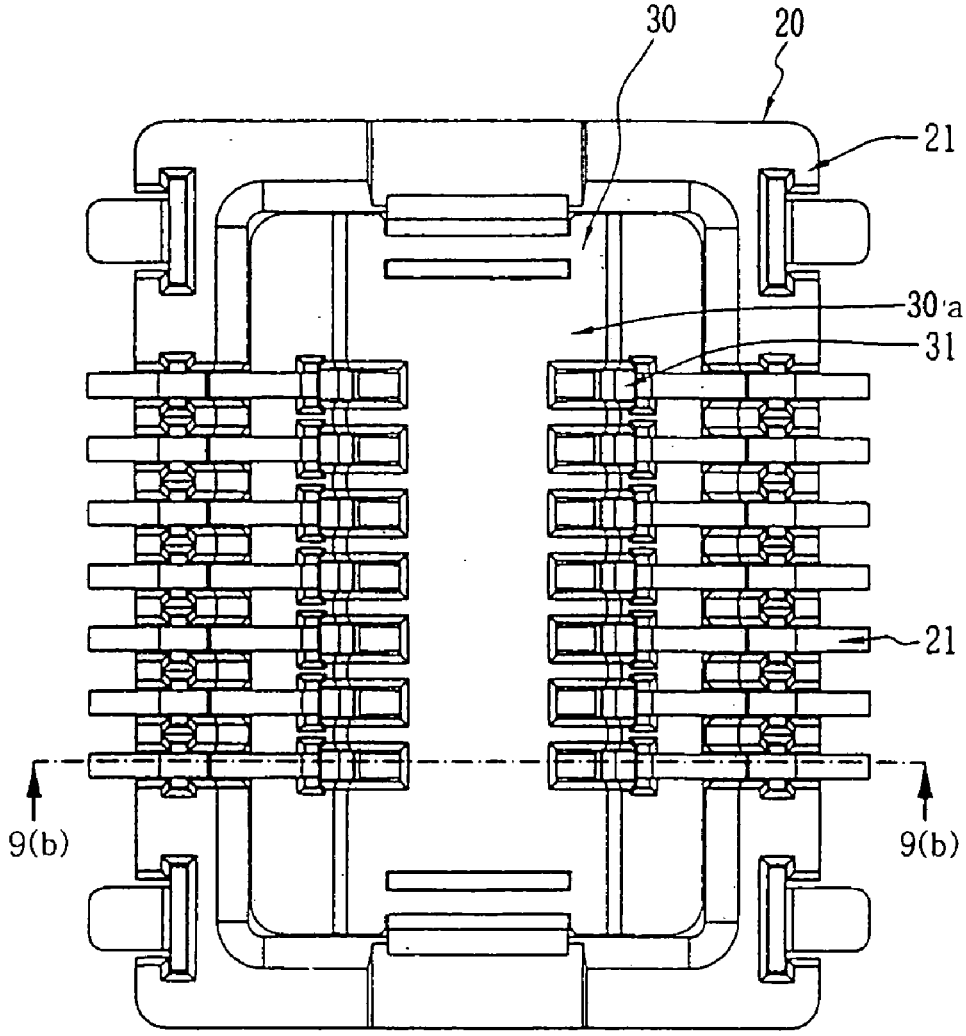
FIG. 9*a* is a top view of the electrical view shown in FIG. 8.
Figure 9B:
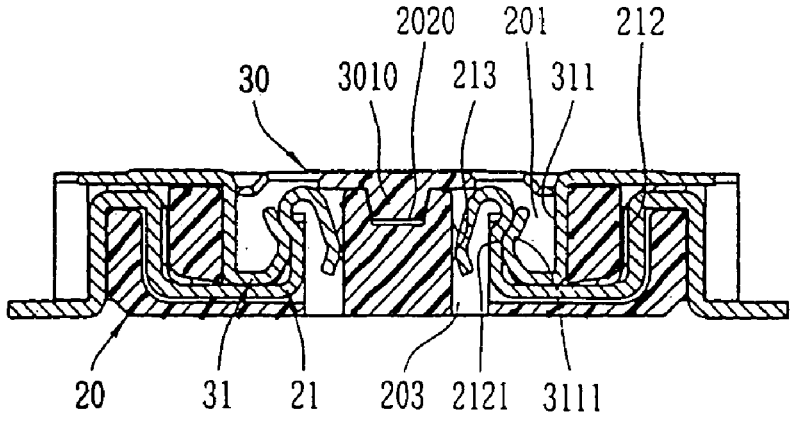
FIG. 9*b* is a cross-section view along direction 9(*b*)-9(*b*) in FIG. 9*a*.

As generally shown in FIGS. 8, 9*a* and 9*b* in conjunction with FIGS. 4 and 5, the alignment block 304 of the plug connector 300 is aligned with the alignment hole 205 of the socket connector 200, and the alignment block 304 is received and positioned in the alignment hole 205 (refer to FIGS. 6*a* and 7*a*). At the same time, the elongated central portion 3010 of the plug connector 300 is inserted into the recess 2020 of the socket connector 20 to provide auxiliary positioning. The second inverted U-shaped portion 311 of the second terminal 31 enters the mating space 201 of the socket connector 200 to mate with the base U-shaped portion 212, in which the second elastic-contact portion 3111 of the second terminal 31 abuts against the first elastic-contact portion 2121 of the first terminal 21, inducing the second elastic-contact portion 3111 to flex inwardly and the first elastic-contact portion 2121 to flex outward, thereby developing corresponding elastic biases. In addition, the auxiliary-clamping portion 213 of the first terminal 21 is pressed by the first terminal-receiving slot 203, and consequently the first elastic-contact portion 2121 develops more force against elastic deformation. Accordingly, after the first terminal 21 mates with the second terminal 31, the forces of the first elastic-contact portion 2121 and the second elastic-contact portion 3111 provide more contact pressure for the contact points therebetween. Moreover, the end of first elastic-contact portion 2121 bends inwardly to withhold the second elastic-contact portion 3111, so as to assure they will not separate.

The first terminal's base U-shaped portion of the socket connector of the present invention has larger thickness than the prior art and the auxiliary clamping portion of the first terminal is supported by the first terminal-receiving slot. Therefore, more force can be provided in spite of the short terminal dimension. In addition, the present invention provides alignment holes and corresponding alignment blocks to improve the alignment, and thus largely increases the positioning accuracy during mating.

The above-described embodiments of the present invention are intended to be illustrative only. Those skilled in the art may devise numerous alternative embodiments without departing from the scope of the following claims.

What is claimed is:

1. An electrical connector assembly used to electrically connect first and second circuit boards, comprising:

A) a socket connector fixed to the first circuit board including:

i) an insulating socket base having a mating space to receive portions of a mating plug connector, a plurality of first terminal-receiving slots, and a platform defined by side walls extending in the mating space; and ii) a plurality of first terminals received in the first terminal-receiving slots, each first terminal comprising:

a) a first terminal solder lead connected to a conductive trace on the first circuit board;

b) a first inverted U-shaped portion;

c) a base U-shaped portion having a first leg serving as a first elastic-contact portion; and d) an elastic tail extending generally downward at an angle from an end of the first elastic-contact portion and generally along the first leg and having a free end portion which abuts against a sidewall of the platform in the mating space; and the first terminal lead, the first inverted U-shaped portion, the base U-shaped portion and the elastic tail are connected successively, and B) the mating plug connector fixed to the second circuit board configured to be engaged with the socket connector, including:

i) an insulating plug base having a plurality of second terminal-receiving slots; and ii) a plurality of second terminals received in the second terminal-receiving slots, each second terminal having a second terminal lead connected to a conductive traces on the second circuit board and a second inverted U-shaped portion, wherein the second inverted U-shaped portion is inserted into the base U-shaped portion of the first terminal to form an electrical connection with the first elastic contact portion of the socket connector when the plug connector is engaged with the socket connector.

2. The electrical connector assembly of claim 1, wherein the first inverted U-shaped portion of the first terminal comprises a first leg and a second leg, the first leg extends from the first terminal lead and two edges of the first leg are provided with tabs to secure the first terminal in a corresponding position of the first terminal-receiving slot and the second leg is connected to a leg of the base U-shaped portion.

3. The electrical connector assembly of claim 2, wherein the elastic tail has a transverse bar formed at the free end portion which abuts against the inside wall of the corresponding first terminal-receiving slot.

4. The electrical connector assembly of claim 1, wherein a rib is provided inside each first terminal-receiving slot of the insulating socket base and fits within the first inverted U-shaped portion.

5. The electrical connector assembly of claim 1 wherein the platform in the socket connector has an elongated recess and the plug connector has an elongated central portion which is inserted in the elongated recess to provide auxiliary positioning.

6. The electrical connector assembly of claim 1, wherein the second inverted U-shaped portion comprises a third leg and a fourth leg, the third leg serving as a second elastic-contact portion is positioned away from the second terminal lead and bent inwardly and the fourth leg is provided with tabs protruding from two edges thereof.

7. The electrical connector assembly of claim 1, wherein a stop portion is provided inside each second terminal-receiving slot of the insulating plug base and positioned between the second terminal lead of the second terminal and the second inverted U-shaped portion, and abuts against the corresponding leg of the second inverted U-shaped portion.

8. The electrical connector assembly of claim 1, wherein at least one alignment hole is formed in the insulating socket base of the socket connector, at least one alignment block is correspondingly formed in the insulating plug base of the plug connector, and the alignment block is received in the alignment hole when the socket connector is engaged with the plug connector.

9. A socket connector fixed to a first circuit board for engaging with a mating plug connector fixed to a second circuit board, comprising:

A) an insulating socket base having a mating space to receive portions of the mating plug connector, a plurality of first terminal-receiving slots, and a platform defined by side walls extending in the mating space; and B) a plurality of first terminals received in the first terminal-receiving slots, each first terminal comprising:

i) a first terminal solder lead connected to a conductive trace on the first circuit board;

ii) a first inverted U-shaped portion; a base U-shaped portion having a first leg sewing as a first elastic-contact portion engageable with a terminal in the mating plug connector; and iii) an elastic tail extending generally downward at an angle from an end of the first elastic-contact portion and generally along the first leg and having a free end portion which abuts against a sidewall of the platform in the mating space; and the first terminal lead, the first inverted U-shaped portion, the base U-shaped portion and the elastic tail are connected successively.

10. The socket connector of claim 9, wherein the first terminal solder lead of the first terminal extends out of the bottom of the insulating socket base for being soldered on the first circuit board.

11. The socket connector of claim 9, wherein the first inverted U-shaped portion of the first terminal comprises a first leg and a second leg, the first leg extends from the first terminal solder lead and two edges of the first leg are provided with tabs to secure the first terminal in a corresponding position of the first terminal-receiving slot; and the second leg is connected to a leg of the base U-shaped portion.

12. The socket connector of claim 9, wherein the base U-shaped portion of the first terminal has an elongated transverse portion exposed to the mating space of the insulating base.

13. The socket connector of claim 9, wherein the free end portion of the elastic tail of the first terminal has a transverse bar which abuts against the sidewall of the platform in the mating space.

14. The socket connector of claim 9, wherein a rib is provided inside each first terminal-receiving slot of the insulating socket base and fits the first inverted U-shaped portion.

15. The socket connector of claim 9, wherein the elastic contact portion has a bent section designed to engage a respective terminal in the mating plug connector.

* * * * *